US011549509B2

(12) United States Patent
Jang et al.

(10) Patent No.: US 11,549,509 B2
(45) Date of Patent: Jan. 10, 2023

(54) ELECTRIC OIL PUMP FOR HYDRAULIC CONTROL AND OIL SUPPLYING SYSTEM PROVIDED WITH THE SAME

(71) Applicants: HYUNDAI MOTOR COMPANY, Seoul (KR); KIA MOTORS CORPORATION, Seoul (KR)

(72) Inventors: Sung Wook Jang, Suwon-si (KR); Kihyup Kim, Hwaseong-si (KR); Woo Jung Kim, Suwon-si (KR); June Ho Lee, Seoul (KR); Jin Seung Lim, Seoul (KR); Seungwan Noh, Seoul (KR); Youngho Moon, Seoul (KR); Taegeun Kim, Seoul (KR); Jaeyeol Yun, Gunpo-si (KR); Jungwook Lee, Yongin-si (KR); Chulwan Park, Hwaseong-si (KR); Chi Hun Cho, Suwon-si (KR); Gyu Chull Doh, Yongin-si (KR); Kyoo Ho Lee, Seoul (KR); Hyun Chul Kim, Suwon-si (KR); Joung Chul Kim, Suwon-si (KR); Hyun Duk Chang, Seoul (KR); Jin Hee Lee, Seongnam-si (KR); Yongho Jung, Suwon-si (KR); Chang Yeon Cho, Seoul (KR); Yun Seok Sung, Yongin-si (KR); Hyeonjin Kim, Suwon-si (KR); Joo Hang Lee, Yongin-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 453 days.

(21) Appl. No.: 16/514,069

(22) Filed: Jul. 17, 2019

(65) Prior Publication Data

US 2020/0309121 A1 Oct. 1, 2020

(30) Foreign Application Priority Data

Mar. 26, 2019 (KR) ..... 10-2019-0034222

(51) Int. Cl.
*F04C 15/00* (2006.01)
*F04C 2/08* (2006.01)
*F04C 13/00* (2006.01)

(52) U.S. Cl.
CPC ..... *F04C 15/0096* (2013.01); *F04C 2/08* (2013.01); *F04C 13/001* (2013.01);
(Continued)

(58) Field of Classification Search
CPC ..... F04C 13/005; F04C 15/06; F04C 2/08; F04C 13/001; F04C 13/002; F04C 15/008;
(Continued)

(56) References Cited

U.S. PATENT DOCUMENTS 2,825,286 A * 3/1958 White ..... F04C 11/008 417/371
3,525,001 A * 8/1970 Erickson ..... H02K 9/19 310/59

(Continued)

FOREIGN PATENT DOCUMENTS

CN 104265628 A 1/2015
CN 104884808 A 9/2015
CN 106030110 A 10/2016

*Primary Examiner* — Bryan M Lettman
(74) *Attorney, Agent, or Firm* — Lempia Summerfield Katz LLC

(57) ABSTRACT

An electric hydraulic pump for a transmission includes: a motor including a motor cover, a motor case coupled with the motor cover, and a stator and a rotor disposed within the motor cover and the motor case; and a pump including a
(Continued)

pump case forming a pump chamber, and a gear rotor which is disposed within the pump chamber, connected with the rotor through a motor shaft and receives rotational power of the motor. In particular, a plurality of oil circulation holes are formed in the motor cover and a connecting hole is formed in the motor cover corresponding to the pump case, and an oil flow channel is formed within the pump case for connecting the connecting hole and an oil inlet of the pump chamber.

10 Claims, 5 Drawing Sheets

(52) U.S. Cl.
CPC ..... *F04C 13/005* (2013.01); *F04C 15/0088* (2013.01); *F04C 2210/206* (2013.01); *F04C 2240/30* (2013.01)

(58) Field of Classification Search
CPC ..... F04C 2240/30; F04C 2210/206; F04C 29/04; F04C 15/0096; H02K 5/132; H02K 5/12; H02K 9/19
See application file for complete search history.

(56) References Cited

U.S. PATENT DOCUMENTS 5,181,837 A * 1/1993 Niemiec ..... F04B 1/20 417/205
5,354,182 A * 10/1994 Niemiec ..... F01C 21/007 248/638
6,029,448 A * 2/2000 Hobson ..... B66F 7/16 417/371
8,668,467 B2 * 3/2014 Douglas ..... F04B 35/045 417/223
2015/0308458 A1 * 10/2015 Ueno ..... F04C 29/0092 415/121.2
2016/0238004 A1 * 8/2016 Charwot ..... F04C 2/18
2016/0348675 A1 * 12/2016 Ishii ..... F04C 11/001

* cited by examiner

"PRIOR ART"

ELECTRIC OIL PUMP FOR HYDRAULIC CONTROL AND OIL SUPPLYING SYSTEM PROVIDED WITH THE SAME

CROSS-REFERENCE TO RELATED APPLICATION

This application claims priority to and the benefit of Korean Patent Application No. 10-2019-0034222, filed on Mar. 26, 2019, the entire contents of which are incorporated herein by reference.

FIELD

The present disclosure relates to an electric hydraulic pump for hydraulic pressure control of transmissions and an oil supply system including the same.

BACKGROUND

The statements in this section merely provide background information related to the present disclosure and may not constitute prior art.

Recently, the increase in global oil prices and harsh exhaust gas exhaust regulations have pushed vehicle makers to make more efforts to develop technologies that can improve fuel consumption in an environmentally friendly manner.

Particularly, improvement of fuel consumption in a transmission can be achieved through improvement of power delivery efficiency, and improvement of power delivery efficiency can be achieved by minimizing unnecessary power consumption by a hydraulic pump.

In recent years, as a start clutch has been applied to double clutch transmission (DCT: Double Clutch Transmission) or automatic transmission (AT: Automatic Transmission) instead of a torque converter, an electric hydraulic pump, which may reduce the power loss by adjusting the RPM (revolutions per minute) of the pump to the required flow rate, is used instead of a mechanical hydraulic pump.

In other words, by using an electric hydraulic pump, the supplying of the control oil (control oil for friction members such as clutches and brakes selectively operated at the time of shifting) and lubrication oil (cooling, lubrication) are efficiently managed.

FIG. 1 is a schematic hydraulic circuit diagram of a transmission employing a typical motorized hydraulic pump.

Referring to FIG. 1, the electric hydraulic pump OP includes a motor M and a pump PP. When the pump PP is driven by the motor M, oil is sucked into oil inlet 1 of hydraulic pump OP and discharged through an oil outlet 3 and forms line pressure on a line pressure hydraulic line L.

An accumulator A is disposed on the line pressure hydraulic line L to store the hydraulic pressure while controlling the hydraulic pressure shock. And a plurality of solenoid valves SOL controls the line pressure and actuates friction members such as clutch (C) or brake BK.

We have discovered that in the case of double clutch transmission (DCT) or an automatic transmission (AT) in which an electric hydraulic pump (OP) is applied, control oil and lubrication oil are separated and operated through partition 7 in the transmission housing 5 respectively considering hydraulic pressure efficiency. As a result, there is a drawback in the case of control oil that the rising temperature of the oil temperature is slow. If the temperature rise speed of the control oil is slow, there is a problem that the state where the oil viscosity is high continues for a long time.

Even though there is a method of raising the temperature of the control oil by employing a heat exchanger H of a separate heater, we have found that these methods have limitations in raising the entire temperature of the control oil.

The above information disclosed in this Background section is only for enhancement of understanding of the background of the present disclosure and therefore it may contain information that does not form the prior art that is already known to a person of ordinary skill in the art.

SUMMARY

The present disclosure provides an electric hydraulic pump for hydraulic pressure control of transmissions and an oil supply system including the same for supplying oil to the pump while the oil circulating inside the motor is heated by the heat of the motor so as to function as an oil warmer.

An electric hydraulic pump for a transmission according to an exemplary form of the present disclosure may include: a motor including a motor cover, a motor case coupled with the motor cover, and a stator and a rotor disposed within the motor cover and the motor case; and a pump including a pump case forming a pump chamber, and a gear rotor disposed within the pump chamber. In particular, the pump is connected with the rotor through a motor shaft and receives rotational power of the motor, a plurality of oil circulation holes may be formed in the motor cover, and a connecting hole may be formed in the motor cover corresponding to the pump case. An oil flow channel may be formed within the pump case for connecting the connecting hole and an oil inlet of the pump chamber.

The electric hydraulic pump may further include a filter disposed between the motor cover and the pump case corresponding to the connecting hole of the motor cover.

The filter may be mounted to a stepped portion formed on the oil flow channel within the pump case.

The filter may include a circular guider and a mesh mounted within the circular guider.

An electric hydraulic pump for a transmission according to an exemplary form of the present disclosure may include: a motor including a motor cover, a motor case coupled with the motor cover, and a stator and a rotor disposed within the motor cover and the motor case; and a pump including a pump case forming a pump chamber and a gear rotor disposed within the pump chamber, where the pump is connected with the rotor through a motor shaft and receives rotational power of the motor, and wherein a plurality of oil circulation holes may be formed in the motor cover and a connecting hole may be formed in the motor cover corresponding to the pump case, and wherein an oil flow channel may be formed inside the pump case. In particular, the oil circulated through the plurality of oil circulation holes flows into the motor case and may be heated by the heat of the motor and supplied to the pump chamber through the connecting hole and the oil flow channel.

The electric hydraulic pump may further include a filter disposed between the motor cover and the pump case corresponding to the connecting hole of the motor cover. The filter may be mounted to a stepped portion formed on the oil flow channel within the pump case.

The filter may include a circular guider and a mesh mounted within the circular guider.

An oil supply system for a transmission according to an exemplary form of the present disclosure may include: a motor case; a motor cover coupled with the motor case and having an oil connecting hole and a plurality of oil circulation holes through which oil is supplied; a stator and a rotor mounted in the motor case and the motor cover; a pump case connected to the motor cover, wherein an oil flow channel communicated with the connecting hole is formed in the pump case, and the pump case forms a pump chamber having an inlet receiving the oil from the oil flow channel and an outlet exhausting the oil; a gear rotor mounted within the pump case and rotated by the rotor connected with the gear rotor, and a plurality of solenoid valves receiving the oil from the oil outlet.

The oil supply system may further include a filter disposed between the motor cover and the pump case corresponding to the connecting hole of the motor cover.

In an exemplary form of the present disclosure, since a plurality of oil circulation holes are formed in an external circumference of a motor cover and a connecting hole is formed in a side of the motor cover corresponding to a pump case and an oil flow channel is formed inside the pump case, and thus, the oil circulated into the motor case is directly heated by the heat of the stator and the rotor, and is directly supplied to the pump through the oil inlet.

Thus, even if the temperature of the entire oil in the transmission housing does not rise, the oil circulating in the motor case is heated by the motor and inflows into the oil inlet, so that even in a low temperature environment unfavorable to clutch and brake control, the temperature of the transmission oil can be rapidly increased to solve the problems such as responsiveness deteriorated and shift shock.

In addition, the stator of the motor is cooled by the oil circulating inside the motor case, and the function of oil warmer to the oil which is flowed into the pump may be performed, so that the use of the existing heat exchanger can be excluded and energy efficiency may be enhanced.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
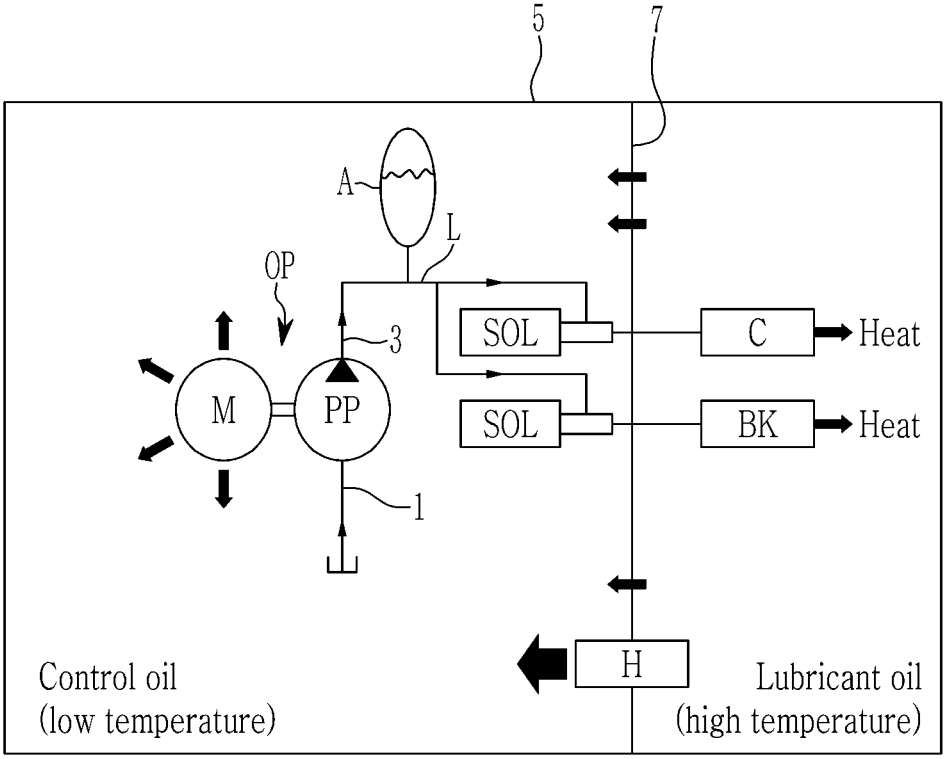
FIG. 1 is a schematic hydraulic circuit diagram of a transmission employing a typical motorized hydraulic pump.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

As those skilled in the art would realize, the described forms may be modified in various different ways, all without departing from the spirit or scope of the present disclosure.

The drawings and descriptions are to be regarded as illustrative in nature and not restrictive. Throughout the specification, the same reference numeral applies to the same or similar constituent elements.

Figure 2:
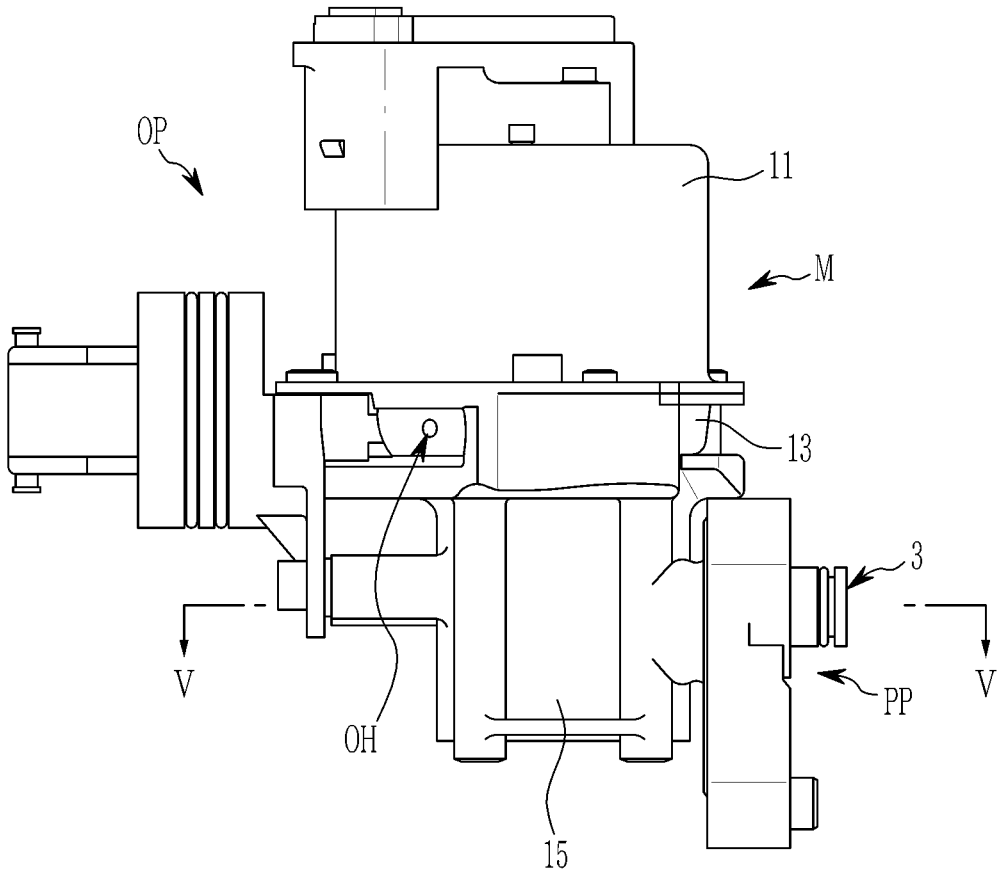
FIG. 2 is a drawing illustrating an electric hydraulic pump for transmission according to an exemplary form of the present disclosure.
Figure 3:
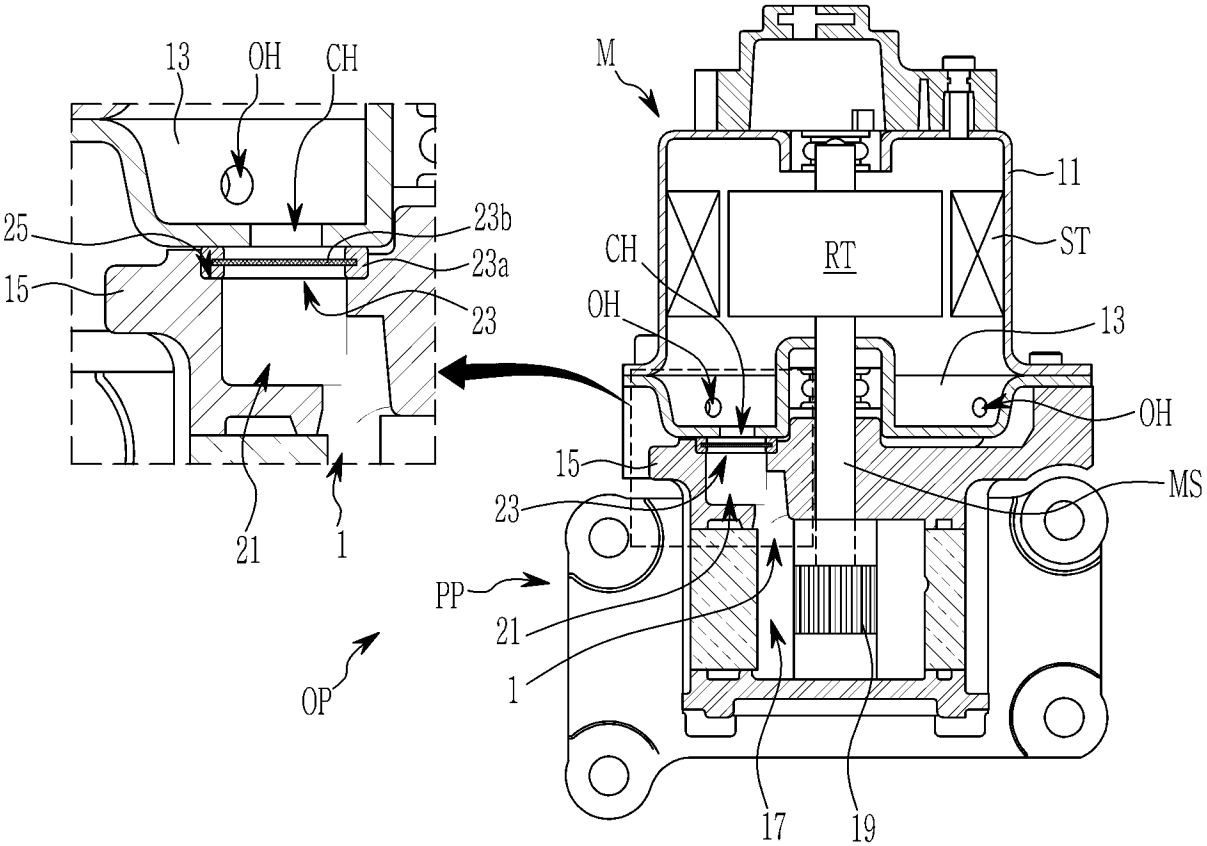
FIG. 3 is a cross-sectional view of an electric hydraulic pump for transmission according to an exemplary form of the present disclosure.

FIG. 2 is a drawing illustrating an electric hydraulic pump for transmission according to an exemplary form of the present disclosure and FIG. 3 is a cross-sectional view of an electric hydraulic pump for transmission according to an exemplary form of the present disclosure.

Figure 4:
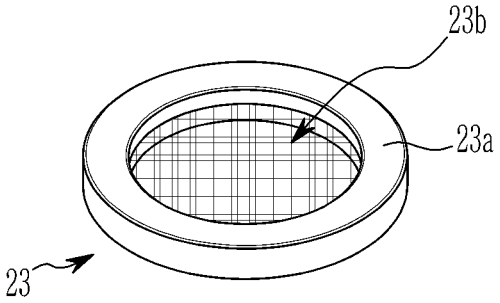
FIG. 4 is a perspective view of a filter applied to an electric hydraulic pump for transmission according to an exemplary form of the present disclosure.
Figure 5:
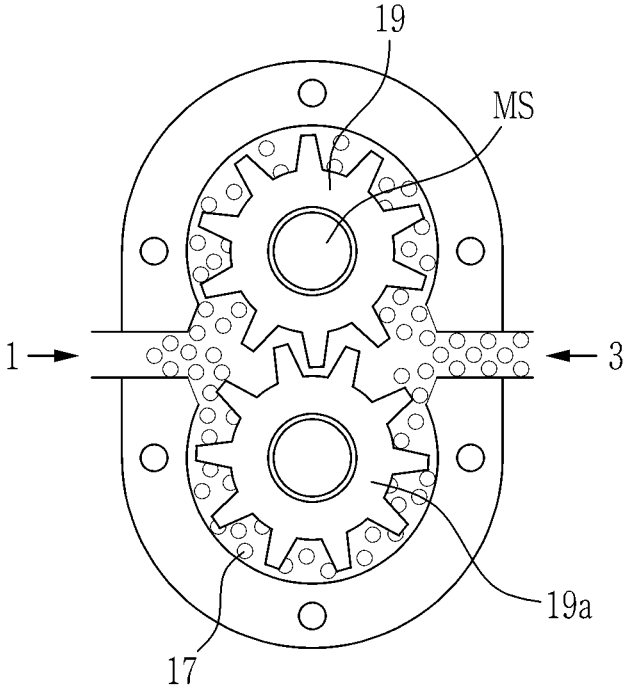
FIG. 5 is a cross-sectional view along line V-V of FIG. 2.

FIG. 4 is a perspective view of a filter applied to an electric hydraulic pump for transmission according to an exemplary form of the present disclosure and FIG. 5 is a cross-sectional view along line V-V of FIG. 2.

Referring to FIG. 2 to FIG. 5, an electric hydraulic pump for transmission OP according to an exemplary form of the present disclosure includes a motor M and a pump PP.

The motor M includes a motor case 11 and a motor cover 13 coupled to the motor case 11 and a stator ST and a rotor RT disposed within the motor cover 13 and the motor case 11. And the pump PP includes a pump case 15 of which a pump chamber 17 is formed therein, and a gear rotor 19 disposed within the pump chamber 17, connected with the rotor RT through a motor shaft MS and receiving rotational power of the motor M.

The pump PP may be an external gear pump including two gears 19 and 19*a* externally gear meshed each other mounted within the pump chamber 17.

That is, the first gear 19 is connected with the motor shaft MS and the second gear 19*a* is externally gear meshed with the first gear 19, and the pump PP exhausts the oil from an oil inlet 1 through an oil outlet 3 according to rotation of the motor M.

The pump applied to the electric oil pump according to the exemplary form of the present disclosure is not limited to the external gear pump shown in FIG. 5. That is, various types of pumps such as an internal gear pump and a vane pump may be applied.

A plurality of oil circulation holes OH are formed to the motor cover 13 and a connecting hole CH is formed to the motor cover 13 corresponding to the pump case 15.

The oil contained in the oil reservoir or oil tank is inflow into the motor M through the oil circulation hole OH and the stator ST and the rotor RT are cooled and supplied to the pump PP through the connection hole CH while the temperature is raised.

The pump case 15 has an oil flow channel 21 formed therein to connect the connecting hole CH to the oil inlet 1 of the pump chamber 17.

In response to the connecting hole CH of the motor cover 13, a filter 23 is installed between the motor cover 13 and the pump case 15 to prevent the material contained in the oil from being inflowed into the pump chamber 17.

Referring to FIG. 4, the filter 23 includes a circular guider 23*a* and a steel mesh 23*b* coupled with inside the circular guider 23*a* and the guider 23*a* is installed in a stepped portion 25 formed on the oil flow channel 21 inside the pump case 15.

The filter 23 is inserted into the stepped portion 25 through the guider 23*a* and the pump case 15 and the motor cover 13 are assembled and fixed.

Figure 6:
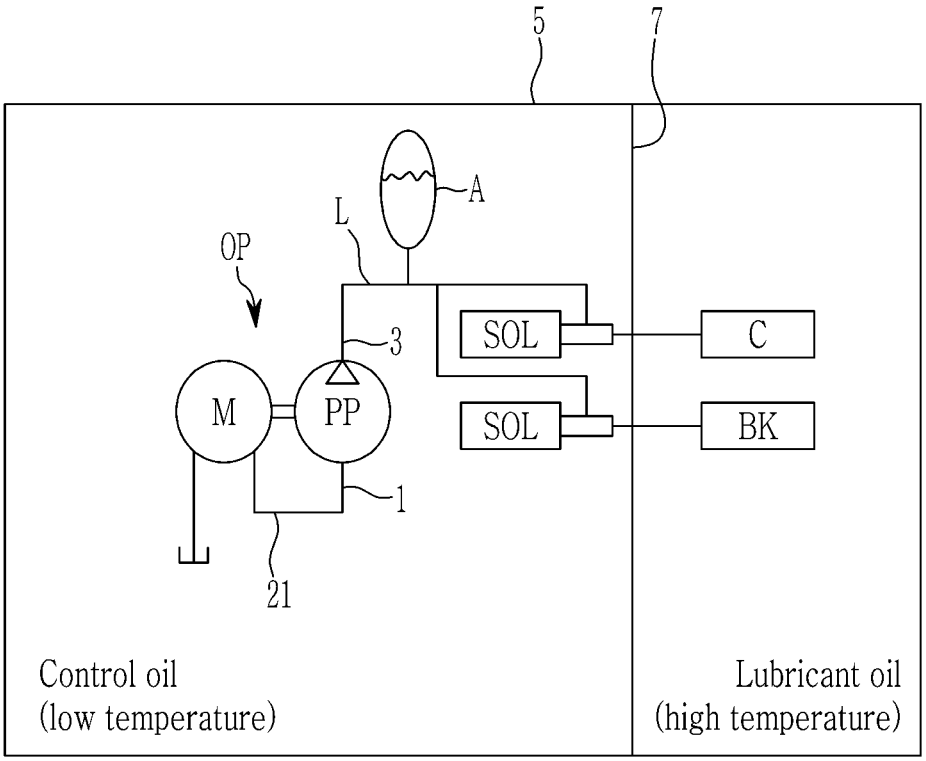
FIG. 6 is a schematic hydraulic circuit diagram of a transmission employing an electric hydraulic pump according to an exemplary form of the present disclosure.

FIG. 6 is a schematic hydraulic circuit diagram of a transmission employing an electric hydraulic pump according to an exemplary form of the present disclosure.

Referring to FIG. 6, in a hydraulic circuit OP the electric hydraulic pump OP according to an exemplary form of the present disclosure is immersed in the oil, and the oil is supplied to the motor case 11 through the plurality of oil circulation holes OH formed in the motor cover 13 and is heated by the heat of the motor M while circulating.

That is, the oil is heated by absorbing heat while cooling the stator ST which is the heat source of the motor M.

Thus, the heated oil is supplied to the pump chamber 17 through the oil inlet 1 along the connecting hole CH formed on one side of the motor cover 13 and the oil flow channel 21 formed inside the pump case 15.

Here, regarding the heating of the oil, for example, a temperature sensor was installed on the surface of the motor case 11, and about 4 degrees per minute was obtained when the motor was driven. Based on this temperature can be expected to rise by more than 4 degrees per minute (about 0.1 liter).

In the electric hydraulic pump for transmission OP according to an exemplary form of the present disclosure the oil inflows into the motor case 11 through the plurality of oil circulation holes OH on the motor cover 13 assembled in the motor case 11, and the stator ST, which is the heat source of the motor M, is directly cooled.

The heated oil absorbed from the motor M is directly supplied to the pump chamber 17 of the pump PP through the connecting hole CH formed on the motor cover 13, the oil flow channel 21 on the pump case 15 and the oil inlet 1.

Then, the oil with the increased temperature is supplied via the oil outlet 3 to a plurality of solenoid valves SOL via a line pressure hydraulic line L.

The solenoid valve SOL controls the operation of the clutch C or brake BK using the heated oil, so that control responsiveness may be improved.

Even though a partition 7 is formed inside the transmission housing 5 to separate the lubrication oil and the control oil from each other, the use of the existing heat exchanger H and the like can be excluded.

That is, even if the temperature of the entire oil in the transmission housing 5 does not rise, the oil circulating in the motor case 11 is supplied to the pump PP while being directly heated by the heat source of the motor M, and thus operations of the clutch C or the brake BK can be controlled. Therefore, even in environments with low temperatures, the temperature of the transmission oil can be raised rapidly so as to maintain responsiveness and prevent shift shocks of the clutch C and the brake BK.

In addition, the hydraulic pump OP according to an exemplary form of the present disclosure can exclude the use of the existing heat exchanger H through the function of the oil warmer, thereby further enhancing the energy efficiency.

While this present disclosure has been described in connection with what is presently considered to be practical exemplary forms, it is to be understood that the present disclosure is not limited to the disclosed forms. On the contrary, it is intended to cover various modifications and equivalent arrangements included within the spirit and scope of the present disclosure.

DESCRIPTION OF SYMBOLS

| | |
|---|---|
| 1: oil inlet | 3: oil outlet |
| 5: transmission housing | 7: partition |
| OP: hydraulic pump | M: motor |
| PP: pump | A: accumulator |
| L: line pressure hydraulic line | H: heat exchanger |
| C: clutch | BK: brake |
| 11: motor case | 13: motor cover |
| 15: pump case | OH: oil circulation hole |
| CH: connecting hole | 17: pump chamber |
| 19: gear rotor | 21: oil flow channel |
| 23: filter | 23a: guider |
| 23b: mesh | 25: stepped portion |
| ST: stator | RT: rotor |
| MS: motor shaft | |

What is claimed is:

1. An electric hydraulic pump for a transmission, comprising:

a motor including a motor cover, a motor case coupled with the motor cover, and a stator and a rotor disposed within a space defined by the motor cover and the motor case; and a pump including a pump case forming a pump chamber, and a gear rotor disposed within the pump chamber, the pump connected with the rotor through a motor shaft and configured to receive rotational power of the motor, wherein the space extends into a recess formed in the motor cover, and the recess is open to the motor case and wherein the recess is formed by a bottom wall and a sidewall of the motor cover, wherein a plurality of oil circulation holes are formed in the sidewall of the motor cover and a connecting hole is formed in the bottom wall of the motor cover corresponding to the pump case, wherein an oil flow channel is formed within the pump case and configured to connect the connecting hole and an oil inlet of the pump chamber, and wherein oil is circulated through the plurality of oil circulation holes and subsequently flows into the motor case where the oil is heated by heat of the motor and then directly supplied to the pump chamber through the connecting hole and the oil flow channel.

2. The electric hydraulic pump of claim 1, further comprising a filter disposed between the motor cover and the pump case corresponding to the connecting hole of the motor cover.

3. The electric hydraulic pump of claim 2, wherein the filter is mounted to a stepped portion defining a portion of the oil flow channel within the pump case.

4. The electric hydraulic pump of claim 2, wherein the filter comprises:

a circular guider; and a mesh mounted within the circular guider.

5. An electric hydraulic pump for a transmission, comprising:

a motor including a motor cover, a motor case coupled with the motor cover, and a stator and a rotor disposed within a space defined by the motor cover and the motor case; and a pump including a pump case forming a pump chamber, and a gear rotor disposed within the pump chamber, the pump connected with the rotor through a motor shaft and configured to receive rotational power of the motor, wherein the space extends into a recess formed in the motor cover, and the recess is open to the motor case and wherein the recess is formed by a bottom wall and a sidewall of the motor cover, wherein a plurality of oil circulation holes are formed in the sidewall of the motor cover and a connecting hole is formed in the bottom wall of the motor cover corresponding to the pump case, wherein an oil flow channel is formed inside the pump case, and wherein oil is circulated through the plurality of oil circulation holes and subsequently flows into the motor case where the oil is heated by heat of the motor and then directly supplied to the pump chamber through the connecting hole and the oil flow channel.

6. The electric hydraulic pump of claim 5, further comprising a filter disposed between the motor cover and the pump case corresponding to the connecting hole of the motor cover.

7. The electric hydraulic pump of claim 6, wherein the filter is mounted to a stepped portion defining a portion of the oil flow channel within the pump case.

8. The electric hydraulic pump of claim 6, wherein the filter comprises:

a circular guider; and a mesh mounted within the circular guider.

9. An oil supply system for a transmission, comprising:

a motor case;

a motor cover coupled with the motor case and having an oil connecting hole and a plurality of oil circulation holes through which oil is supplied, wherein the plurality of oil circulation holes are formed in a sidewall of the motor cover and the connecting hole is formed in a bottom wall of the motor cover;

a stator and a rotor mounted in a space defined by the motor case and the motor cover;

a pump case connected to the motor cover, wherein an oil flow channel communicated with the connecting hole is formed in the pump case, and the pump case forms a pump chamber having an inlet configured to receive the oil from the oil flow channel and an outlet configured to discharge the oil;

a gear rotor mounted within the pump case and rotated by the rotor connected with the gear rotor; and a plurality of solenoid valves receiving the oil from the oil outlet, wherein the space extends into a recess formed in the motor cover, and the recess is open to the motor case and wherein the recess is formed by the bottom wall and the sidewall of the motor cover, and wherein oil is circulated through the plurality of oil circulation holes and subsequently flows into the motor case where the oil is heated by heat of the motor and then directly supplied to the pump chamber through the connecting hole and the oil flow channel.

10. The oil supply system of claim 9, further comprising a filter disposed between the motor cover and the pump case corresponding to the connecting hole of the motor cover.

* * * * *